United States Patent [19]

Verhoog, Jr.

[11] Patent Number: 4,615,454

[45] Date of Patent: Oct. 7, 1986

[54] BOX FOR STORING COMBUSTIBLE SUBSTANCES

[75] Inventor: Cornelis Verhoog, Jr., Oostzaan, Netherlands

[73] Assignee: Verhoog's Handelsonderneming B.V., Zaandam, Netherlands

[21] Appl. No.: 734,350

[22] Filed: May 14, 1985

[30] Foreign Application Priority Data

May 21, 1984 [NL] Netherlands ..... 8401626

[51] Int. Cl.[4] ..... B65D 25/00

[52] U.S. Cl. ..... 220/88 R; 220/1 T; 220/201

[58] Field of Search ..... 220/88 R, 89 B, 1 T, 220/201

[56] References Cited

U.S. PATENT DOCUMENTS

| | | | |
|---|---|---|---|
| 1,832,056 | 11/1931 | Spencer | 220/88 R |
| 1,834,989 | 12/1931 | Young | 220/88 R |
| 2,474,934 | 7/1949 | Domagall | 220/88 R |
| 2,679,949 | 6/1954 | Clinton | 220/88 R |
| 2,685,984 | 8/1954 | Lisciani | 220/88 R |
| 4,073,401 | 2/1978 | Pecchenino | 220/201 X |
| 4,148,411 | 4/1979 | Hodge et al. | 220/1 T X |
| 4,182,459 | 1/1980 | Williams | 220/88 R |
| 4,361,247 | 11/1982 | Williams | 220/88 R |

FOREIGN PATENT DOCUMENTS

| | | | |
|---|---|---|---|
| 0099542 | 7/1980 | Japan | 220/201 |

*Primary Examiner*—Steven M. Pollard
*Attorney, Agent, or Firm*—Daniel C. McKown

[57] ABSTRACT

A box for storing combustible or easily inflammable substances comprising heat-insulated side and bottom walls and a heat-insulated cover pivotally connected to one side wall, means being provided for equilibrating the weight of said cover in the open position thereof, said equilibrating means being connected to said cover by a heat-sensitive coupling, the latter being adapted to disrupt the connection between said equilibrating means and said cover when a predetermined temperature is exceeded so as to cause said cover to be closed by its own weight.

3 Claims, 2 Drawing Figures

BOX FOR STORING COMBUSTIBLE SUBSTANCES

BACKGROUND OF THE INVENTION

For storing combustible substances in a laboratory, safety cabinets are known which comprise insulating walls and doors, the latter being provided with closing means and being adapted to be held in the open position by means of a latch which is released at a predetermined temperature raise, so that, then, the doors are automatically closed. Such cabinets are suitable as well for screening combustible substances against an external fire as for protecting the surroundings against easily inflammable substances.

Such cabinets are generally used for storing stocks in a laboratory, and have excellent satisfied for this purpose.

If, however, combustible or easily inflammable substances must remain within the reach of a person performing experiments, such substances will constitute a risk, even if present in small amounts. On the other hand the above-mentioned safety cabinets are rather bulky, which may be an objection in smaller laboratories and/or if the amounts of dangerous substances to be stored are small.

BRIEF SUMMARY OF THE INVENTION

The invention provides a store box for such purposes which is characterised by walls and a cover provided with a heat-insulation, which cover is pivotally connected, at one side, with a wall, by means for equilibrating, at least in the open position, the weight of said cover, and, thus, keeping said cover open, and by a heat-sensitive coupling between said cover and said equilibrating means, which are adapted, when exceeding a predetermined temperature, to disconnect the connection between said cover and said equilibrating means, so as to cause said cover to be closed by its own weight.

Such a box is, in particular, suitable to be placed below a laboratory table, the cover at the upper side making said box, which is situated at a lower level, easily accessible. The cover can be easily opened and closed because of said weight equilibration, and remains in the open position. Dangerous substances can remain within the reach of the user, and remain, nevertheless, protected in the desired manner. When releasing the coupling between said equilibrating means and the cover, the weight of the cover is made operative immediate, so that the cover is quickly closed and is kept closed.

In particular the cover is provided with lateral skirts overlapping, in the closed position, the side walls, and the coupling and associated parts are arranged at the inner side of a skirt, so that the insulation of said side walls needs not to be interrupted for mounting said parts.

In a preferred embodiment said equilibrating means comprise a pivot arm situated at the inner side of a cover skirt and coupled with said skirt by means of a bimetallic latch, and having a pivot axis substantially coinciding with the hinge axis of said cover, the length of said arm being so that, also in the disconnected condition, it remains free from the adjacent cover parts, so that under no circumstances a force can be exerted on said cover which might prevent a complete closing of said cover.

In order to allow to test the unlatching, in particular an unlatching knob is provided on said lateral skirt which is adapted to release the bimetallic latch, which knob can also be used when the cover is to be closed and pushing said cover by hand is difficult.

BRIEF DESCRIPTION OF THE DRAWINGS

The invention will be elucidated below in more detail by reference to a drawing, showing in.

DESCRIPTION OF A PREFERRED EMBODIMENT

Figure 1:
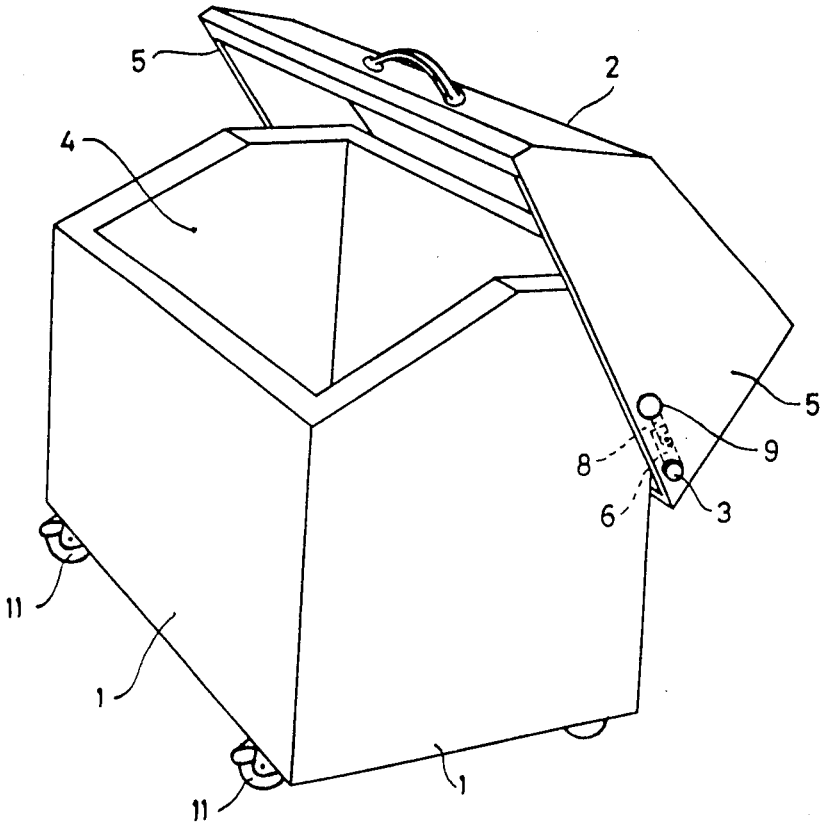
FIG. 1 a simplified representation in perspective of a box according to the invention.

The box according to the invention shown in the drawing comprises upstanding walls 1, which, in particular, each consist of an inner and an outer metallic wall and an interposed insulation.

A cover 2 is pivotally connected to said box by means of a hinge connection 3, and, in the closed position thereof, will completely close the opening 4 of said box. The portion of said cover closing said opening 4 is constructed in substantially the same manner as the walls 1, and the weight of said cover is sufficient to keep the box closed even under unfavourable conditions (e.g. an internal overpressure), and, if required, sealing means which swell when being heated can be provided so as to prevent vapours or combustion gases from leaking out.

As shown, the cover 2 is provided, at all sides, with lateral skirts 5 covering, in the closed position, the joints between said cover 2 and the walls 1 in question, thus providing an additional protection. The hinge connection 3 is, moreover, connected to the lateral skirts 5, thus providing a more favourable position of the hinge axis in respect of the centre of gravity of the cover in the open position.

Figure 2:
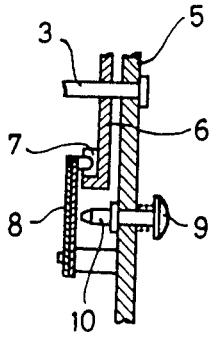
FIG. 2 a diagrammatical cross-section of a portion of the cover of said box for elucidating the security means thereof.

FIG. 2 shows a partial section through a lateral skirt 5 where the safety means for the box are arranged. A pivot arm 6 is rotatably supported on said pivot axis 3 (or on an axis near the latter one). Said arm 6 is, moreover, connected to spring means, not shown, tending to force said arm in the sense of the open position of the cover 2. Such spring means will provide, then, a spring force which is sufficient to keep the cover 2 in the open position shown. When closing the cover, the position of the centre of gravity of the cover will change in respect of the hinge axis because of the low position of said hinge axis, so that, then, said spring force will no longer fully equilibrate the weight, and a differential force will remain, closing the cover and keeping the latter closed. Damping means coupled with said spring means are adapted to attenuate the closing movement in a suitable manner. Spring and damping means suitable for that purposes are known in various forms, and need not te be described in detail.

The free extremity of the arm 6 carries a stop 7 which, in the normal condition, abuts an extremity of a bimetallic latch 8, the latter being connected to the lateral skirt 5. In the normal condition, the arm 6 can exert a force in the opening sense on the cover 2.

When, however, a temperature raise occurs which exceeds a predetermined value, e.g. 57° C., the bimetallic latch is moved to such an extent that it releases the stop 7, so that, then, the own weight of the cover 2 is no longer equilibrated by the action of the spring means on the arm 6, and the cover will be very rapidly closed. The length of said arm 6 is such that said arm, which on being unlatched rotates in the opposite sense, cannot contact portions of said cover 2 in any point so that, under all circumstances, the cover weight will be completely available for keeping said cover closed. A temi-nal stop, not shown, will prevent a rotation of said arm 6 beyond a given extreme position. When opening the cover again, the arm 6 can be brought into engagement with the latch 8.

In order to test the operation of said security means, or to obtain a fast closing also without a temperature rise, a springloaded unlatching knob 9 is provided, the inner extremity 10 of which being adapted, when actuating the knob, to push aside the bimetallic latch 8 for bringing about the unlatching. This knob can also be used for re-engaging the stop 7 with the latch 8 after opening the cover 2 again.

The box shown can be provided with wheels 11 adapted to be locked. This box can easily be positioned so that it is accessable for the user in the most convenient manner, and, for instance, the box can be pushed under a laboratory table after work hours.

What is claimed is:

1. A box for protecting combustible substances from fires originating outside the box, said box comprising:

walls;

a cover pivotally mounted to at least one of said walls, and having a closed position and an open position;

insulative material disposed within said walls and said cover to protect the combustible substances from the heat and flames of fires outside the box;

a skirt attached to said cover, extending downward from said cover when said cover is in its closed position and partially covering but spaced from a first wall of said walls when said cover is in its open position;

equilibrating means connected to said first wall for counterbalancing the weight of said cover in the open position so that when the cover has been pivoted to the open position it will remain in that position;

a bimetallic latch interconnecting said cover and said equilibrating means to hold said cover in the open position at room temperatures, and operative at an elevated temperature associated with a fire to disconnect said cover from said equilibrating means, wherey when said elevated temperature has been reached said cover falls to the closed position under the action of gravity;

said equilibrating means and said bimetallic latch located outside of the box in the space between said skirt and said first wall, whereby said bimetallic latch, by being outside rather than inside the box, responds more quickly to fires outside the box.

2. The box of claim 1 wherein said equilibrating means further comprise a pivot arm situated in the space between said skirt and said first wall and pivotable about substantially the same axis as the cover.

3. The box of claim 1 further comprising in combination:

an unlatching knob mounted on said skirt and selectively operable by a user to disconnect said bimetallic latch from said equilibrating means to permit said cover to be closed at room temperatures.

* * * * *